US008536979B2

(12) United States Patent
Tsuyuzaki

(10) Patent No.: US 8,536,979 B2
(45) Date of Patent: Sep. 17, 2013

(54) AUTHENTICATION APPARATUS AND AUTHENTICATION METHOD USING RANDOM PULSE GENERATOR

(76) Inventor: Noriyoshi Tsuyuzaki, Mobara (JP)

( * ) Notice: Subject to any disclaimer, the term of this patent is extended or adjusted under 35 U.S.C. 154(b) by 849 days.

(21) Appl. No.: 10/591,070

(22) PCT Filed: Feb. 17, 2005

(86) PCT No.: PCT/JP2005/002963

§ 371 (c)(1),
(2), (4) Date: Aug. 30, 2006

(87) PCT Pub. No.: WO2005/083643

PCT Pub. Date: Sep. 9, 2005

(65) Prior Publication Data

US 2008/0235774 A1 Sep. 25, 2008

(30) Foreign Application Priority Data

Mar. 2, 2004 (JP) ..... 2004-057629

(51) Int. Cl.
*G08C 19/00* (2006.01)

(52) U.S. Cl.
USPC ..... 340/5.8; 340/5.1

(58) Field of Classification Search
USPC ..... 340/825, 5.1–5.2, 5.8–5.18, 5.8–5.81
See application file for complete search history.

(56) References Cited

U.S. PATENT DOCUMENTS

| | | | | |
|---|---|---|---|---|
| 4,209,782 | A * | 6/1980 | Donath et al. | 235/382.5 |
| 5,076,971 | A * | 12/1991 | Barker | 588/1 |
| 6,697,829 | B1 * | 2/2004 | Shilton | 708/255 |

FOREIGN PATENT DOCUMENTS

| | | | |
|---|---|---|---|
| DE | 42 13 988 | A1 | 11/1993 |
| EP | 0 903 665 | A2 | 3/1999 |
| EP | 903665 | A2 * | 3/1999 |
| EP | 0 957 220 | A1 | 11/1999 |
| EP | 957220 | A1 * | 11/1999 |
| JP | 7-233663 | A | 9/1995 |
| JP | 8-257216 | A | 10/1996 |
| JP | 9-28899 | A | 2/1997 |
| JP | 10-110563 | A | 4/1998 |
| JP | 10-142340 | A | 5/1998 |
| JP | 10-252328 | A | 9/1998 |
| JP | 11-013319 | A | 1/1999 |
| WO | WO 9941834 | A1 * | 8/1999 |

OTHER PUBLICATIONS

A Notification of Reason for Refusal issued May 6, 2010, in Japanese Patent Application No. 2005-040034.

* cited by examiner

*Primary Examiner* — Brian Zimmerman
*Assistant Examiner* — James Yang
(74) *Attorney, Agent, or Firm* — Kubovcik & Kubovcik

(57) ABSTRACT

This invention provides an authentication apparatus and an authentication method using a random pulse generator for generating completely random pulses and using a completely random signal as an authentication signal. The authentication apparatus includes: a random pulse generator (hereinafter referred to as the RPG), arranged in a body or a partner side or in both the body and the partner side which generates random pulses; a unit which outputs an authentication signal based on the random pulses generated by the RPG; a unit which stores the authentication signal; a communication unit which transmits/receives an authentication signal; and a control unit which controls the communication of an authentication signal and collate an authentication signal, whereby a complete security can be maintained and safety can be established on the part of the user.

15 Claims, 7 Drawing Sheets

AUTHENTICATION APPARATUS AND AUTHENTICATION METHOD USING RANDOM PULSE GENERATOR

TECHNICAL FIELD

The present invention relates to an authentication apparatus and an authentication method using a completely random signal as an authentication signal from a random pulse generator to generate completely random pulses.

BACKGROUND ART

In the conventional authentication apparatus such as an electronic lock, a key manufacturer determines an authentication data in advance, and completes and sells, as a set, a key body (or a lock) and a key to be inserted into the key body. The user purchases the complete product and uses by mounting it on the front door, for example, at a required point. In electronic locks of other types, the time when the lock has been shut is stored in the key body and the key as authentication data, which is collated at the time of opening the lock (Japanese Patent Application Laid-open No. H07-233663), or a voiceprint (or a voice pattern) is used as authentication data (for example, Japanese Patent Application Laid-open No. H08-257216).

DISCLOSURE OF THE INVENTION

The conventional authentication apparatuses are discussed below with reference to the electronic lock as a specific application. In the conventional electronic locks fabricated with authentication data predetermined by the manufacturer, the authentication data are fixed and cannot be freely changed (actually, the manufacturer creates the authentication data according to a program, and the number of sets thereof is limited, so that the same authentication data is liable to be used undesirably), or even if changeable, the authentication data is input by ten-keys or the like and therefore the number of digits and the number of sets available are limited.

In many cases, the manufacturer is required to hold the authentication data of the products for maintenance and services necessitates a vast amount to secure confidentiality. When the key sets are limited, for example, the chance of the same authentication data being used increases. The manufacturer, therefore, is required to manage the keys by taking care not to distribute the same key sets in the same area. Further, the prevention of data leakage unavoidably depends on the quality of the manager, and therefore the preventive measures cannot be complete and limited.

Incidentally, when a plurality of the same authentication data are used, the use of an electronic lock, for example, in an automotive vehicle may also inconveniently open the door of another vehicle which may be parked in the same parking lot.

Assume, on the other hand, that the locked time is used as authentication data. In view of the fact that time is data changing regularly with time, however, the locked time is not proper as authentication data requiring irregularities. The data may be easily decoded from the number of digits thereof, or a copy key can be easily fabricated by simultaneous use, thereby inconveniently posing the security problem.

The authentication data using the voiceprint, on the other hand, requires a complicated device to identify the voiceprint and therefore is not suitable as a generally applicable electronic lock.

Both time and the voiceprint depend on the external environments (namely an authentication signal completely free of environmental factors cannot be generated in the key or the key body). The key system, therefore, can be unlocked by the artificial operation of a person having full knowledge of the mechanism thereof, and has a limit in security.

This invention has been achieved to obviate the problems of the conventional authentication apparatuses, or especially the electronic lock described above, and an object thereof is to provide an authentication apparatus comprising a body, a partner side paired with the body, in which there are compared with a random pulse generator (hereinafter referred to as the RPG), arranged in the body or the partner side or in both the body and the partner side, which generates random pulses, a means which outputs authentication data based on the random pulses generated by the RPG, a means which stores authentication data, a communication means which transmits/receives authentication data, and a control means which controls the communication of authentication data and collates authentication data.

Another object of the invention is to provide an authentication method comprising the steps of: generating random pulses by a random pulse generator (hereinafter referred to as the RPG) arranged in a body or a partner side paired with the body or in both in the body and the partner side; outputting authentication data based on the random pulses generated by the RPG; storing authentication data; transmitting/receiving authentication data; and controlling the communication of authentication data and collating authentication data.

In the authentication apparatus and the authentication method according to this invention, a RPG utilizing the a particles infinitely released by the natural collapse, for example, is incorporated in the key body, and an original, random signal completely free of the effects of the environmental conditions and never controllable artificially is obtained from the RPG. This signal is used as an authentication signal of a key. Therefore, the authentication signal can be generated any time in the key, and a new, completely random data can be written each time of use. It is impossible to copy it, and therefore the data management by the key manufacturer is eliminated. In this way, the security of the user is fully maintained and safety established.

BEST MODE FOR CARRYING OUT THE INVENTION

An authentication apparatus and method using a random pulse generator (RPG) according to the invention are explained in detail below with reference to an electronic lock as an embodiment.

Figure 1A:
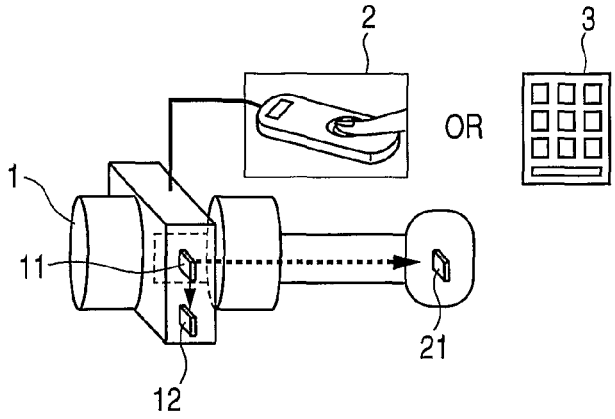
FIG. 1A is a diagram for explaining a key authentication apparatus using a random pulse generator (RPG) according to an embodiment of the invention.
Figure 1B:
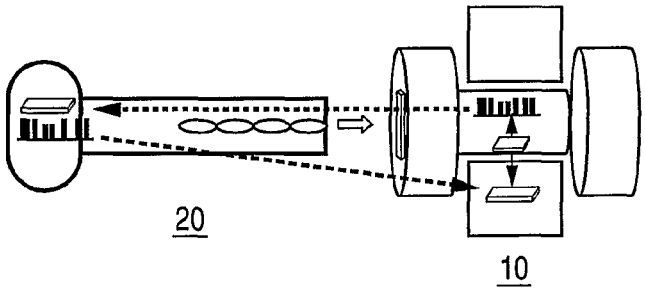
FIG. 1B is a diagram for explaining the manner in which the authentication apparatus shown in FIG. 1A is used.

FIG. 1A is a diagram for briefly explaining an electronic lock according to this invention, and FIG. 1B is a diagram for explaining the manner in which the electronic lock shown in FIG. 1A is used. In the drawings, the reference numeral 1 denotes a door knob, the reference numeral 2 denotes a fingerprint authentication apparatus, the reference numeral 3 denotes a ten-key unit, the reference numeral 10 denotes an electronic lock body, the reference numeral 11 denotes a random pulse generator (hereinafter referred to as the RPG) built in the electronic lock body, the reference numeral 12 denotes a memory built in the electronic lock body, the reference numeral 20 denotes a key, and the reference numeral 21 denotes a memory built in the key.

The RPG used for generating completely random pulses is constituted of an a particle detector described in, for example, Japanese Patent No. 2926539 granted to the present inventor. The α particle radiator used in this case is $^{241}$Am, $^{244}$Cm, $^{210}$Pb-$^{210}$Po, $^{210}$Po, or the like which naturally collapses. In the case of the electronic lock used for the part having a shield space such as a safety box, the RPG for generating random pulses using the beta ray or the gamma ray may be used.

The α particles, the beta ray and the gamma ray are not affected by the environmental factors such as temperature, pressure, humidity or electromagnetic wave, and therefore cannot be controlled artificially. This property is an important factor to secure safety which cannot be realized by other methods. For the electronic lock used for the part not requiring a complete safety, on the other hand, thermal electrons or semiconductor jitters may be used as a source of random pulses.

The key body has built therein a RPG, an electronic circuit for making it possible to use the random pulses sent out from the RPG as an authentication signal, a circuit (storage element) for storing the authentication signal, a circuit for transmitting and receiving the authentication signal in accordance with the communication mode and, if necessary, an antenna, a communication device, a power supply, etc. Incidentally, power may alternatively be supplied from an external source by communication (electromagnetic induction, radio wave or terminal connection).

First, a random pulse generator (RPG) 11 for generating random pulses voluntarily is explained.

Figure 2:
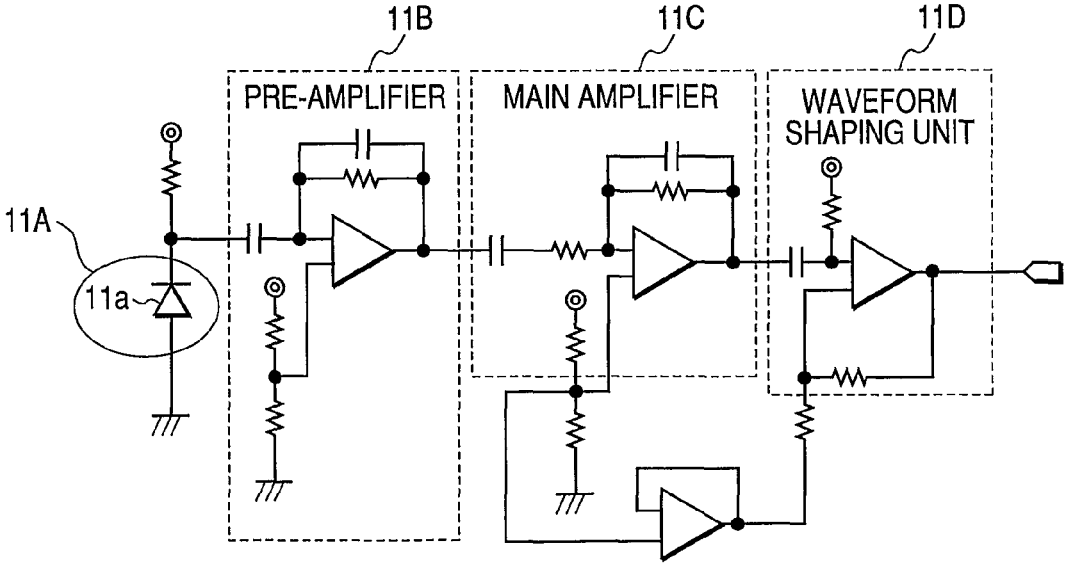
FIG. 2 is a block diagram showing a random pulse generator used in an embodiment of the invention.

The RPG, as shown in FIG. 2, includes a pulse generating unit 11A, a pre-amplifier 11B, a main amplifier 11C and a waveform shaping unit 11D.

Figure 3:
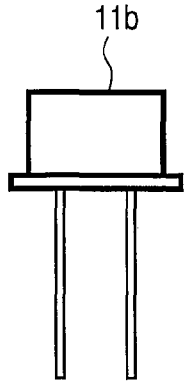
FIG. 3 is a front view showing a diode with an $\alpha$ radiator used with the random pulse generator according to the invention.

The pulse generating unit 11A is, configured of a device selected in accordance with the safety required of the key (electronic lock). For the key requiring the highest safety, a device (diode with the α particle radiator) having an α particle radiator shown in FIG. 3 is used. In the drawing, the reference numeral 11*b* denotes a can seal. The α particles (He atoms) are released from the α radiator semipermanently and voluntarily in accordance with the half life period thereof without any power supply in a manner completely free of the effects of the environmental factors such as temperature, pressure or electromagnetic wave. Specifically, this method has the feature that the original signal used for authentication is produced from a signal source totally incapable of human control. This signal source, therefore, can never be changed from outside. Incidentally, the use of a radioactive capsule is disclosed in Japanese Patent No. 2926539 described above.

Figure 4:
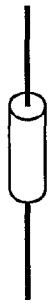
FIG. 4 is a perspective view of a zener diode used with the random pulse generator according to the invention.

When the key mounting portion does not always require complete safety, the pulse generating unit may be configured of a diode (zener diode) as shown in FIG. 4.

In the pre-amplifier 11B, a minute pulse signal generated by the pulse generating unit 11A is amplified as an input signal of the main amplifier 11C.

Figure 5:
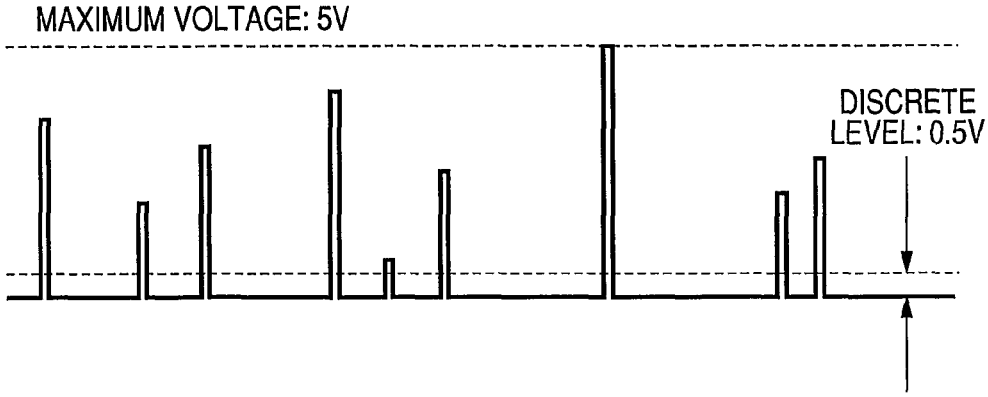
FIG. 5 is a graph showing an example of an output waveform of the random pulse generator according to the invention.

The main amplifier 11C amplifies a signal to discriminate the signal clearly from noises. In this circuit, the voltage of 0.5 or lower containing noises is processed separately as a band containing a noise signal. The voltage processed as a discrete level is set in accordance with the signal strength and noise level required (FIG. 5).

In the waveform shaping unit 11D, a pulse width is added to the pulse output as a leading waveform from the main amplifier 11C so that it can be handled as an authentication signal. The pulse waveform output from the RPG is shown in FIG. 5.

Figure 9:
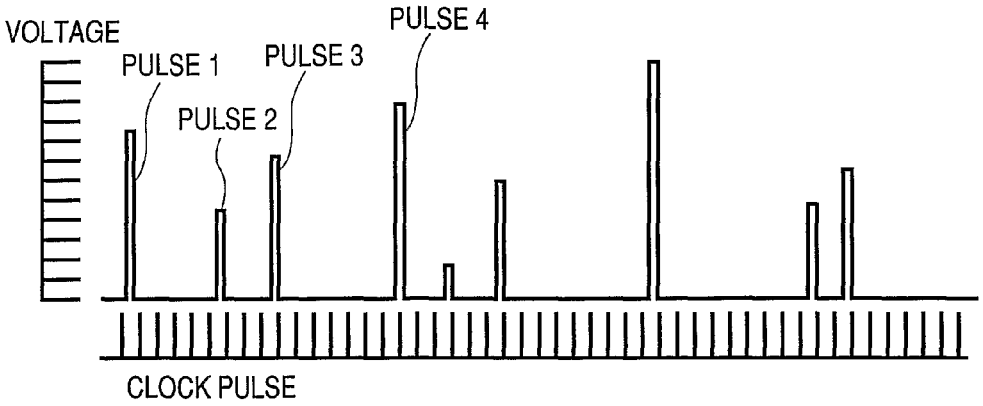
FIG. 9 is a diagram for explaining a method of displaying by classification of the output pulses of the random pulse generator according to the invention.

Incidentally, the random pulse of the RPG has a height (or crest) value and pulse interval which are both random, as shown in FIG. 9. Therefore, the voltage of the height value can be converted into a digital random value, and since the number of clock pulses to measure the pulse interval can also be used as a random value. Also, as shown in the same drawing, a combination of voltage and number of clock pulses may be used. For example, a pulse 1 is given as (9, 5), a pulse 2 is given as (4, 3), a pulse 3 is given as (7, 6) and a pulse 4 is given as (10, 3).

Figure 6:
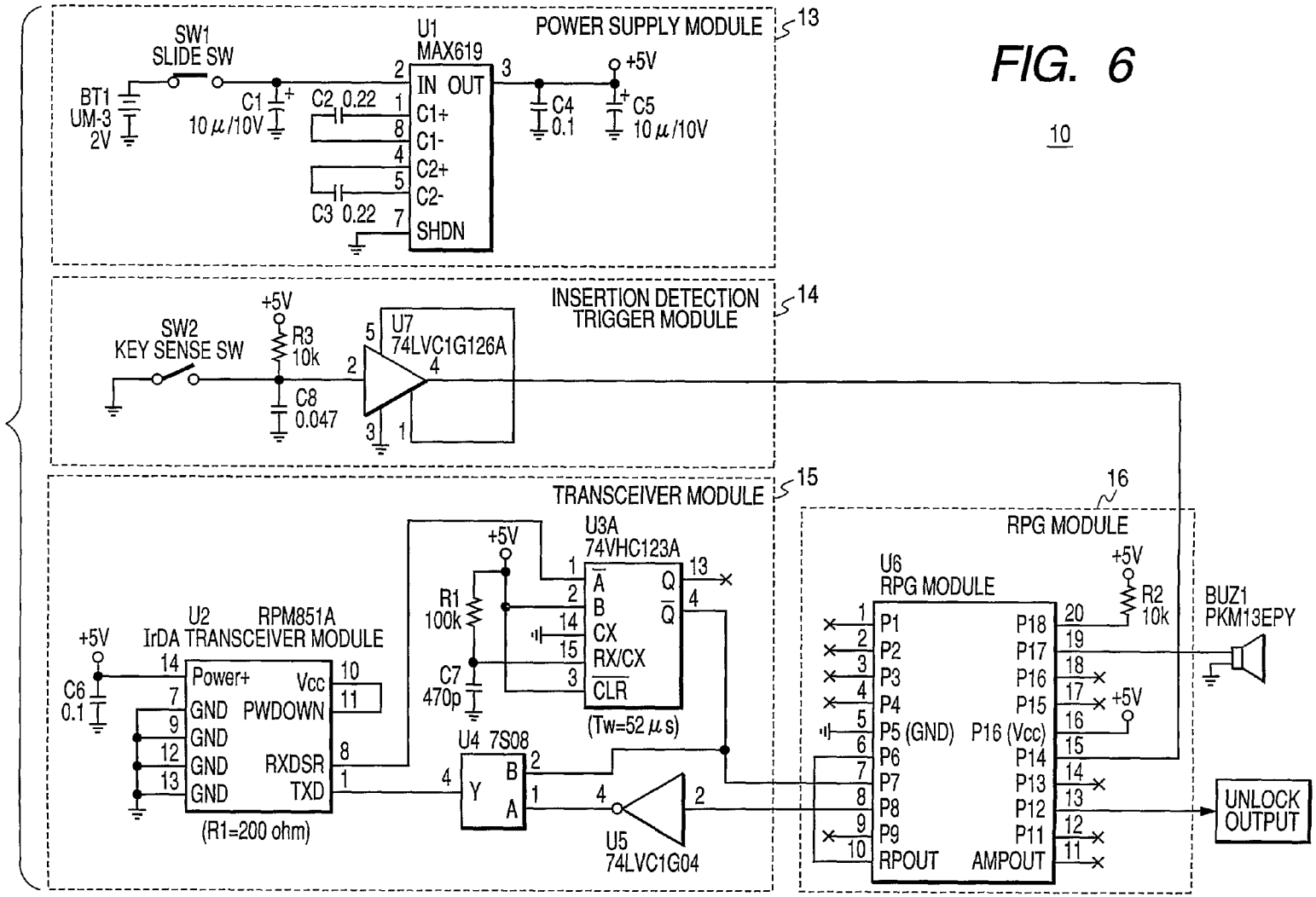
FIG. 6 is a block diagram showing an example of the circuit of the key body according to the invention.

The circuit of the key body is shown in FIG. 6. The key body 10 is configured of a power supply module 13, an insertion detection module 14, a transceiver module 15 and a RPG module 16.

The power supply module 13 supplies an operation power to the constituent circuits as a whole, and according to the embodiment shown in the drawing, includes a DC-DC converter U1 for supplying a stabilized voltage of 5 V.

The insertion detection module 14 detects the insertion of the key constituting the partner side by, for example, the contact between the key body and the key (switch SW2 on), and sends a start signal to the RPG module through a buffer gate U7.

The transceiver module 15 transmits and receives a signal by infrared light communication to and from the key inserted. The reference character U2 denotes an infrared light communication module, and the one used in the shown embodiment is a package of an infrared light emitting LED, a photodiode and a waveform shaping LSI. The reference character U3A denotes a monostable multivibrator which is supplied with the output pulse signal of the infrared light communication module as a trigger signal and sends an output pulse signal to the RPG module U6. Incidentally, the reference character U4 denotes an AND circuit and U5 denotes an inverter circuit to prevent the interference of the signals transmitted to and received from the infrared light communication module. The transceiver module may use a radio communication with light or radio wave other than the infrared light communication.

In the shown embodiment, the transmitting and receiving of the authentication data using the transceiver module is illustrated. Nevertheless, this invention is not limited to such means, but may use a circuit connection by contact as communication means (means for transmitting and receiving the authentication signal).

The RPG module 16, which executes the communication procedures, sends out a signal, receives a signal and stores the data, has built therein a RPG providing a signal source. The RPG module also outputs an unlocking output to open the electronic lock when it is determined that the authentication data of the key body and the key are identical with each other. To open the electronic lock, well known means is used. In the case of an electromagnetic lock mechanism, for example, a control signal is sent to a control means to give an unlock instruction. The communication procedures between the key body and the key are described later.

Figure 10:
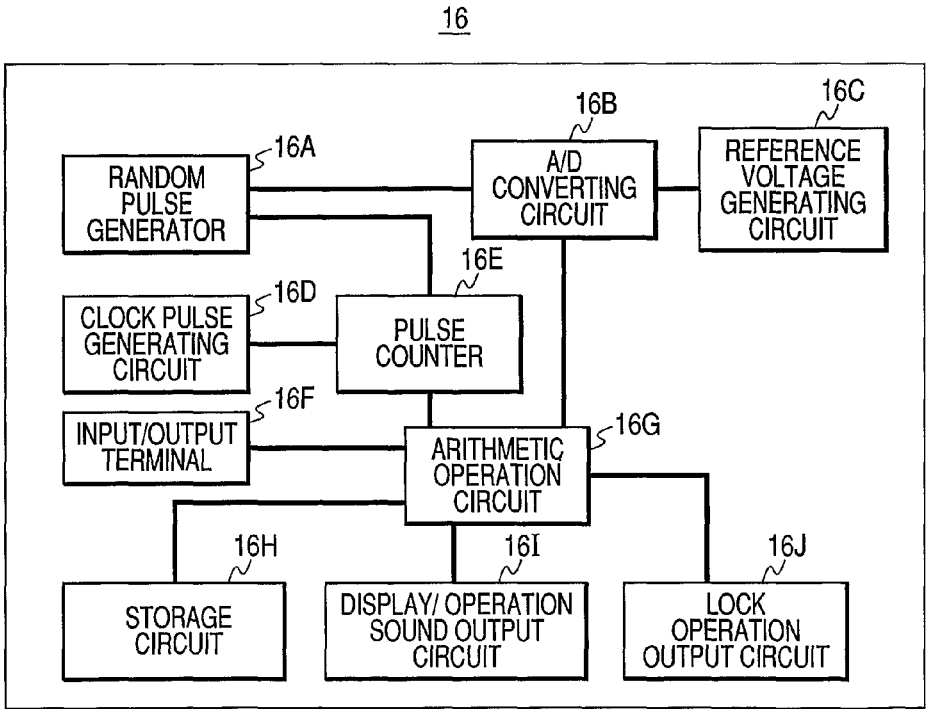
FIG. 10 is a block diagram showing an example of the configuration of a RPG module according to the invention.

FIG. 10 shows an example of configuration of the RPG module. This module is configured of a random pulse generator 16A, an A/D converting circuit 16B, a reference voltage generating circuit 16C, a clock pulse generating circuit 16D, a pulse counter 16E, an input/output terminal (input/output circuit) 16F, an arithmetic operation circuit (arithmetic operation, processing and control circuit) 16G, a storage circuit 16H, a display/operation sound output circuit 16I and a lock operation output circuit 16J. The arithmetic operation circuit 16G determines whether the authentication signal input from the input/output terminal 16F is identical with the authentication signal stored in the storage circuit 16. The result of determination is displayed on the display/operation sound output circuit 16I on the one hand and notified aurally from an external speaker, according to need. In the case of coincidence, an unlock output is produced through the lock operation output circuit.

The interval of the pulses output from the random pulse generator 16A is random, and therefore, the pulse interval is calculated using the clock pulse generating circuit 16D and the pulse counter 16E. The number of clock pulses thus obtained is used as an authentication signal (authentication data). As an alternative, since the height value and the interval of the pulses output from the random pulse generator 16A are random, the voltage of the height value is digitally converted using the A/D converting circuit 16B and the reference voltage generation circuit 16C, and the resulting digital signal is used as an authentication signal (authentication data). The embodiment shown in the drawing is so configured that the authentication signal can be obtained by any one or both of the methods described above. Nevertheless, only one of the configurations may be employed.

In registering a key, the authentication data obtained by the means described above is stored in the storage circuit 16H, while at the same time being sent from the input/output terminal 16F to the transceiver module 15 of the key body. The transceiver module sends the authentication data to the key, and stores it in an operation/storage module 24 through a transceiver module 23 of the key.

The RPG module 16 is not limited to the configuration shown in the drawing, but in accordance with the security level with which the key body (a lock) is mounted, can be replaced with a device having a CPU or a PIC that can construct a determining circuit or an internal clock. A one-chip configuration with ASIC is also possible.

The key inserted into the key body has built therein a circuit and a storage element to store the authentication signal, a circuit for transmitting and receiving the authentication signal corresponding to the communication mode, and if required, an antenna, a communication device and a power supply. The power can alternatively be supplied from an external source by communication (electromagnetic induction, radio wave or terminal connection).

Figure 7:
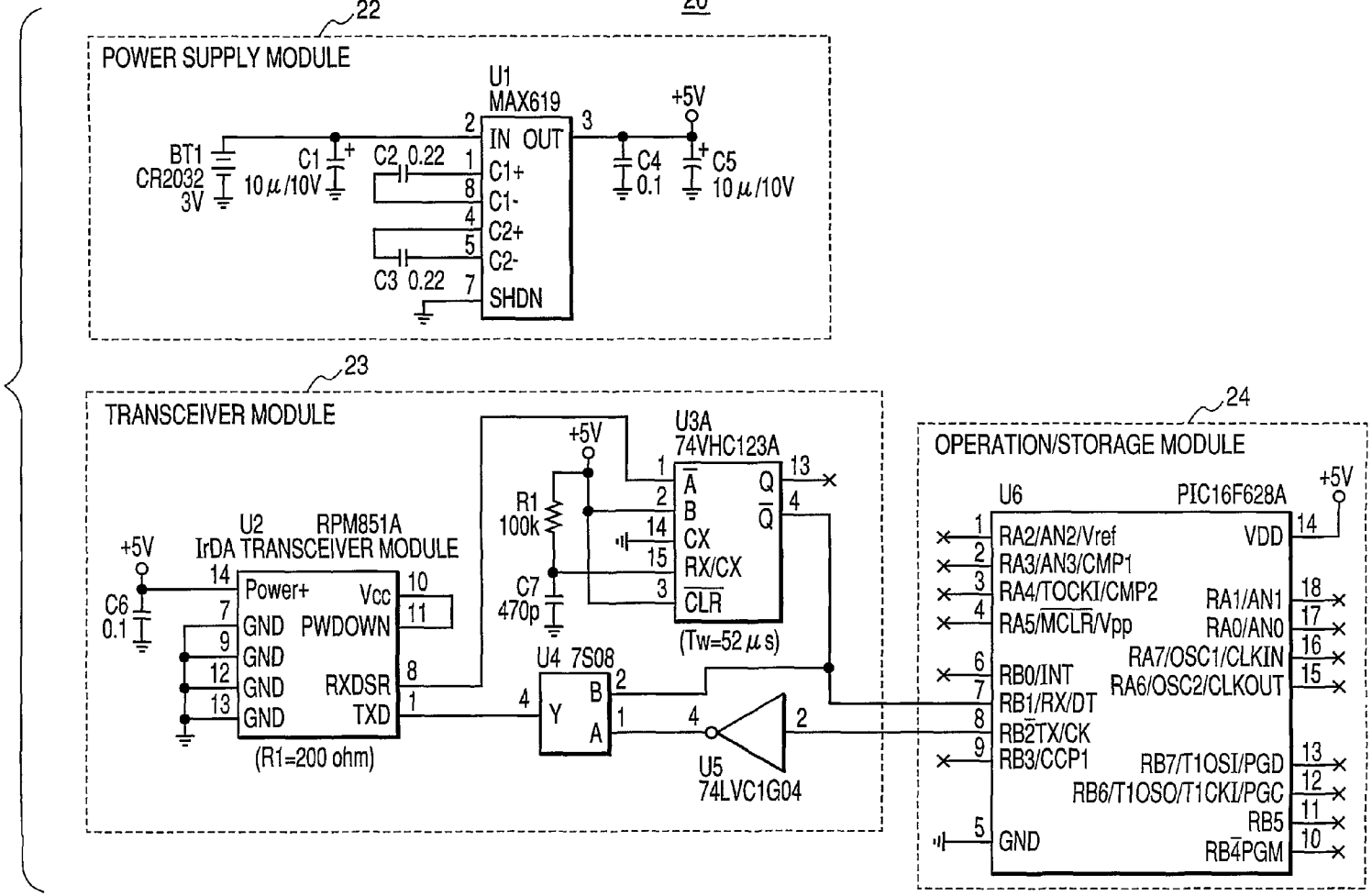
FIG. 7 is a block diagram showing an example of the circuit of the key according to the invention.

The circuit configuration of the key paired with the key body is shown in FIG. 7. The key is configured of a power supply module 22, the transceiver module 23 and the operation/storage module 24. Incidentally, the key may have a shape and configuration like an IC card.

The power supply module 22 supplies the operation power to all the component circuits, and in the shown embodiment, is configured of a DC-DC converter U1 to supply a stabilized voltage of 5 V. According to this embodiment, the power module 22 has such a configuration as to supply the signal power with a battery inserted therein. As an alternative, a switch may be built in to start communication as soon as it is depressed.

The transceiver module 23 is for transmitting and receiving a signal by infrared light communication with the key body. This configuration is similar to that of the transceiver module 15 of the key body. The output of the one-shot multivibrator U3A, however, is sent to the asynchronous receiving port of the operation/storage module 24.

The operation/storage module 24 is a general-purpose PIC (peripheral interface controller) and has an arithmetic operation unit, a memory and an input/output unit. This operation/storage module 24 stores the authentication data and controls the communication between the key body and the key and the collation procedures of the authentication data. The module 24 according the embodiment shown in the drawing also includes a timer and a general-purpose communication port.

Next, the procedures of authenticating the key body and the key are started with registering the key as a partner side of authentication. In key registration, the key is automatically authenticated by insertion and can be registered as a partner side. In accordance with the safety level of the device and unit mounted, however, a fingerprint authentication device 2 or a ten-keys unit 3 (to input the pass word) as shown in FIG. 1A can also be combined.

To register the key, the key is inserted into the body of the electronic lock and a signal is written in the key from the RPG while at the same time being stored in the key body.

For authentication to open the lock, on the other hand, the authentication data sent from the registered key inserted into the key body is compared with the authentication data held in the key body. Upon coincidence of the authentication data, the lock is opened. Once the lock is opened, the data thereof is deleted while at the same time writing new authentication data in both the key body and the key. This authentication procedures and the storage of the authentication data are repeated each time the key is used.

Figure 11:
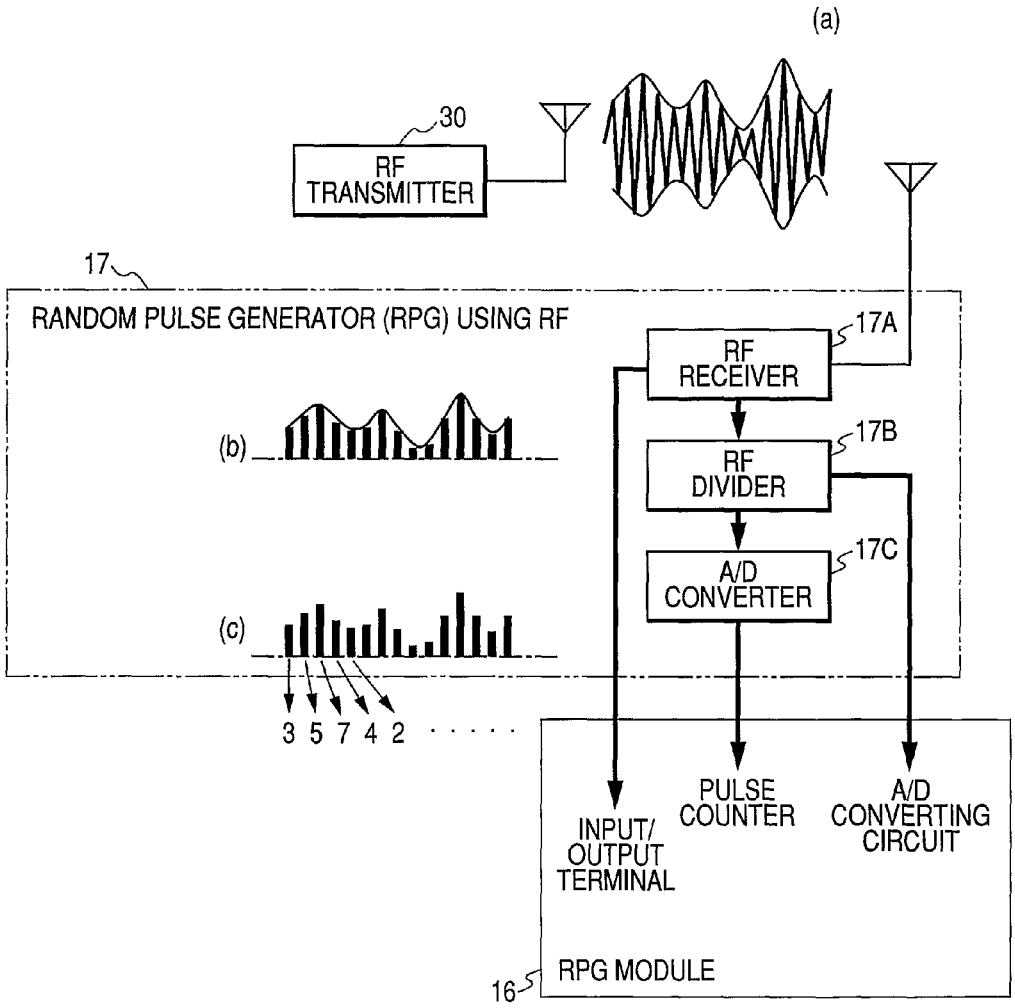
FIG. 11 is a diagram for explaining the configuration of the random pulse generator using RF.

The RPG (random pulse generator) can be so configured as to generate a random pulse by receiving the RF (radio wave) used in an IC tag, for example. FIG. 11 shows a related embodiment. The RF is so weak that it is affected by the propagation conditions (environment, transmitting/receiving distance, or the like) and constitutes a substantially random signal from the viewpoint of e.g. the height value thereof. In FIG. 11, the RF ((a) of FIG. 11) transmitted from the key body, the partner side or a RF transmitter 30 independent of them is received by a RPG 17 of the partner side or the key body. The RPG 17, though plotted as a block different from the RPG module 16 in the shown embodiment, may of course be packaged in the RPG module 16. According to this embodiment, the RPG 17 includes a RF receiver 17A for receiving the RF, a RF dividing circuit 17B (the output waveform of which is shown in (b) of FIG. 11) for dividing (sampling) the RF height value (voltage) by the clock pulse, and an A/D converter 17C for producing a random signal by A/D conversion of the divided height value ((c) of FIG. 11). The output of the A/D converter 17C is transmitted to the pulse counter 16E of the RPG module 16 (FIG. 10). According to this embodiment, the divided height value providing an output of the RF dividing circuit 17B may be directly converted into a digital value by the A/D converting circuit 16B of the RPG module 16, and the resultant numerical value may be used.

In the authentication apparatus or the authentication method according to this invention, the key body or the partner side can include the computer hardware. Also, as a corresponding configuration, the RPG may be mounted on the partner side or the key body, and then mounted integrally or individually to the computer hardware. For example, the RPG is mounted on the computer or a peripheral device (such as a USB memory) connectable with the computer to execute the authentication between the computer and the peripheral device using a random authentication signal.

The authentication steps according to the invention can be programmed. Such an authentication program can be installed in the body, the partner side, or each of them, and it includes, for example, a code to generate random pulses from a random pulse generator arranged in the body or the partner side paired with the body, or in both the key body and the partner side, a code to output authentication data based on the random pulse generated by the RPG, a code to store authentication data, a code to transmit/receive authentication data and a code to control the communication of authentication data and collate authentication data.

Also, the program to control the communication of authentication data and collate authentication data includes, for example, a code to receive authentication data stored in a storage means stored on the partner side, a code to collate the received authentication data with authentication data of a storage means arranged in the body, a code to authenticate the partner side in accordance with the collation result, a code to update authentication data after completion of authentication and a code to write thus updated new authentication data in the storage means of the body and the partner side.

Figure 8:
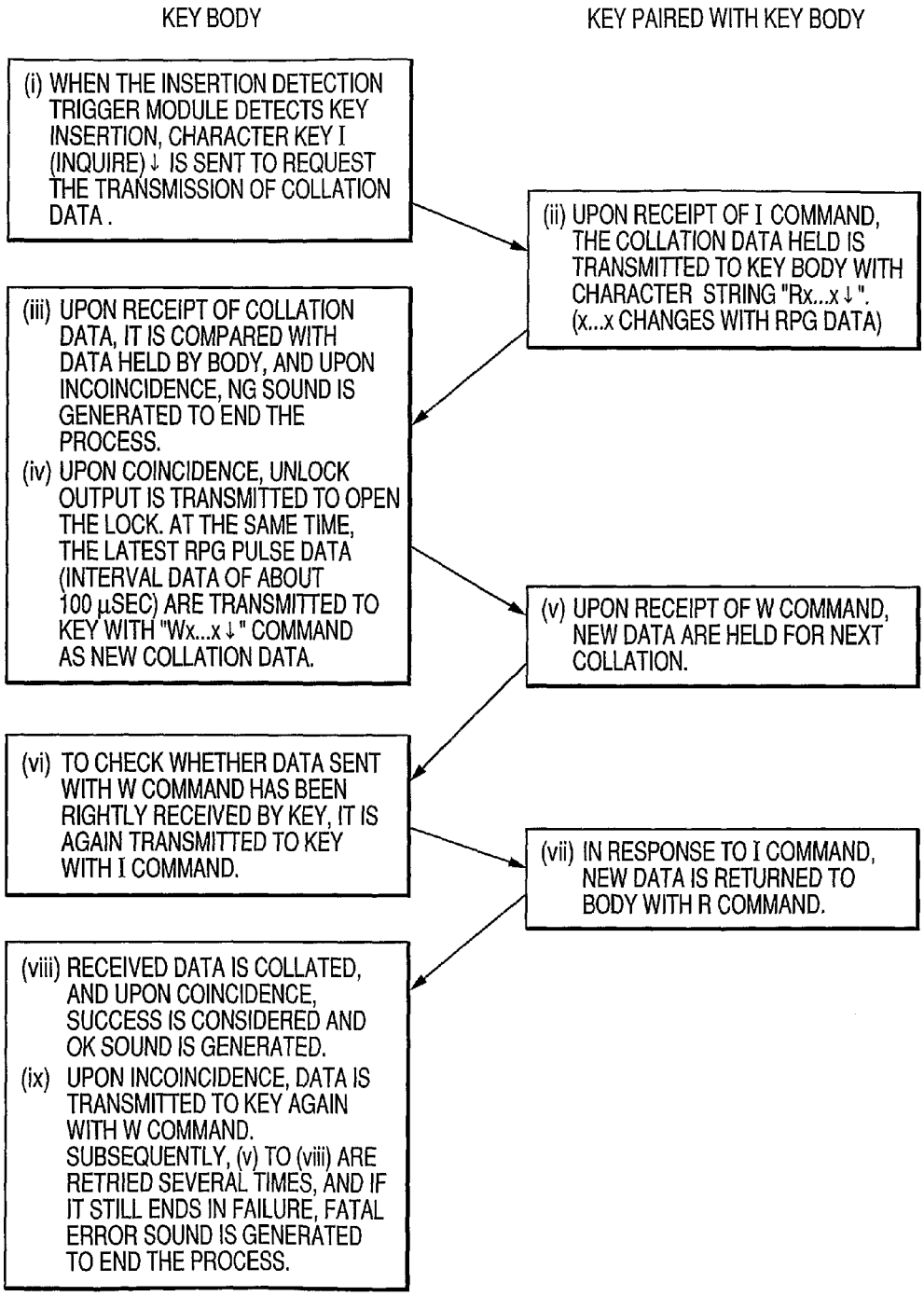
FIG. 8 is a flowchart showing the communication procedures between a key body and a key paired with the key body according to the invention.

The communication procedures between the key body and the key constituting the partner side are shown in detail in FIG. 8.

(i) The key body, upon detection of the key insertion by an insertion detection trigger module, sends the character key I(inquire)↓ (I command) to the key constituting the partner side thereby to request the transmission of the collation data.

(ii) The key, upon receipt of the I command from the key body, transmits the stored collation data to the key body with a character string "Rx . . . x↓" (x . . . x changes with the RPG data).

(iii) The key body, upon receipt of the collation data from the key, compares it with the data held in the key body, and upon incoincidence, generates a NG sound to end the authentication process.

(iv) Upon coincidence in (iii), on the other hand, an unlock output from the RPG module is sent to an appropriate drive control circuit to open the electronic lock. At the same time, the RPG module updates the authentication data (interval data of about 100 μsec) and transmits it to the key as a new authentication data in the command form of Wx . . . x↓".

(v) Upon receipt of the W command, the key holds the new data for the next collation.

(vi) In order to check whether the authentication data sent by the W command is received rightly by the key, the key body transmits the I command again to the key.

(vii) In response to the I command, the key returns the new authentication data to the key body with the R command.

(viii) The key body collates the received authentication data, and upon coincidence, considers the process as a success and generates an OK sound.

(ix) Upon incoincidence in (viii), on the other hand, the data is transmitted again to the key as the W command. Subsequently, the steps (v) to (viii) are repeated several times, and if the process still ends in a failure, a fatal error sound is issued thereby to end the authentication process.

In the case of the fatal error, the authentication data held by the key body and the key remain different from each other, and therefore could not be used permanently as they are. To avoid this inconvenience, according to this invention, the process is initialized according to the steps described below to forcibly enable both units to hold the same data.

(i) The 20 pins of the RPG module are shorted to GND.

(ii) The key is inserted into a lever switch (insertion detection trigger module).

(iii) The initialization is successful if the OK sound is generated.

These steps used in this method are illustrative, and the initialization is possible also by another process. In any way, it is important to select a method by which safety can be secured.

INDUSTRIAL APPLICABILITY

An example in which the RPG is built in the body of the electronic lock is explained above. This invention, however, is not limited to such a configuration and applicable to an IC tag, or the like. The RPG can be incorporated in the body, the partner side or both the body and the partner side. Also, the communication procedures and the authentication procedures between the key body and the partner side can of course be changed in accordance with the arrangement of the RPG, the memory and the communication/authentication control units.

The invention claimed is:

1. An authentication apparatus comprising a body, and a partner side paired with the body, the apparatus comprising: a random pulse generator, arranged in the body or the partner side, or in both the body and the partner side, which generates random pulses; a means which outputs authentication data based on both a random pulse voltage and a random pulse interval of the random pulses generated by the random pulse generator; a means which stores authentication data, a communication means which transmits/receives authentication data; and a control means which controls the communication of authentication data and collates authentication data, wherein the random pulse generator detects a particles, a beta ray or a gamma ray released by the collapse of an atomic nucleus and generates the random pulses, wherein the random pulse interval of the random pulses is measured by counting the number of clock pulses, the counted number of clock pulses is used as a random number, and an interval of the clock pulses is shorter than the interval of the random pulses so as to enable the measurement of the random pulse interval by counting the number of clock pulses, and wherein said authentication data is outputted based on a combination of the random pulse voltage of the random pulses and a number of the clock pulses acquired by measuring the pulse interval of the random pulses.

2. An authentication apparatus according to claim 1, characterized in that the control means receives the authentication data stored in the storage means arranged on the partner side, collates the received authentication data with authentication data of the storage means arranged in the body, and in accordance with the result of collation, authenticates the partner side, and in that upon completion of the authentication, authentication data is updated, and new authentication data thus updated is written in the storage means of the body and the partner side.

3. An authentication apparatus according to claim 1 or 2, further comprising a drive unit control means which controls a drive unit in accordance with the result of collation by the control means.

4. An authentication apparatus according to claim 1 or 2, characterized in that the body is the body of an electronic lock, and the partner side is a key including an IC card.

5. An authentication apparatus according to claim 1, characterized in that an α particle radiator includes $^{241}$Am, $^{210}$Pb-$^{210}$Po, $^{210}$Po and/or $^{244}$Cm, and a beta ray radiator includes $^{210}$Pb.

6. An authentication apparatus according to claim 1 or 2, characterized in that the communication means transmits/receives the authentication data by circuit connection due to contact or by infrared light communication or radio communication.

7. An authentication method comprising the steps of: generating random pulses by a random pulse generator arranged in a body or a partner side paired with the body, or in both the body and the partner side; outputting authentication data based on both a random pulse voltage and a random pulse interval of the random pulses generated by the random pulse generator; storing authentication data; transmitting/receiving authentication data; and controlling the communication of authentication data and collating authentication data, wherein the random pulse generator detects a particles, a beta ray or a gamma ray released by the collapse of an atomic nucleus and generates the random pulses, wherein the random pulse interval of the random pulses is measured by counting the number of clock pulses, the counted number of clock pulses is used as a random number, and an interval of the clock pulses is shorter than the interval of the random pulses so as to enable the measurement of the random pulse interval by counting the number of clock pulses, and wherein said authentication data is outputted based on a combination of the random pulse voltage of the random pulses and a number of the clock pulses acquired by measuring the pulse interval of the random pulses.

8. An authentication method according to claim 7, characterized in that the control step receives the authentication data stored in a storage means mating unit arranged on the partner side, collates the received authentication data with authentication data of a storage means arranged in the body, authenticates the partner side in accordance with the result of collation, and after completion of authentication, updates authentication data, and writes new authentication data thus updated in the storage means of the body and the partner side.

9. An authentication method according to claim 7 or 8, further comprising a drive unit control step for controlling a drive unit in accordance with the result of collation in the control step.

10. An authentication method according to claim 7, characterized in that an α particle radiator includes $^{241}$Am, $^{210}$Pb-$^{210}$Po and/or $^{244}$Cm, and a beta ray radiator includes $^{210}$Pb.

11. An authentication method according to claim 7 or 8, characterized in that the communication step transmits and receives the authentication data by circuit connection due to contact or by infrared light communication or radio communication.

12. An authentication apparatus according to claim 1 or 2, characterized in that the body or the partner side includes the hardware of a computer, and the partner side or the body including the random pulse generator is mounted integrally with or independently of the hardware of the computer.

13. An authentication method according to claim 7 or 8, characterized in that the body or the partner side includes the hardware of a computer, and the partner side or the body including the random pulse generator is mounted integrally with or independently of the hardware of the computer.

14. A non-transitory computer readable memory medium storing an authentication program, said authentication program comprising: a code to generate random pulses from a random pulse generator arranged in a body or a partner side paired with the body, or in both the body and the partner side partner side; a code to output authentication data based on both a random pulse voltage and a random pulse interval of the random pulses generated by the random pulse generator; a code to store authentication data; a code to transmit/receive authentication data; and a code to control the communication of authentication data and collate authentication data, wherein the random pulse generator detects a particles, a beta ray or a gamma ray released by the collapse of an atomic nucleus and generates the random pulses, wherein the random pulse interval of the random pulses is measured by counting the number of clock pulses, the counted number of clock pulses is used as a random number, and an interval of the clock pulses is shorter than the interval of the random pulses so as to enable the measurement of the random pulse interval by counting the number of clock pulses, and wherein said authentication data is outputted based on a combination of the random pulse voltage of the random pulses and a number of the clock pulses acquired by measuring the pulse interval of the random pulses.

15. The non-transitory computer readable memory medium storing an authentication program according to claim 14, characterized in that the code to control the communication of authentication data and collate authentication data includes: a code to receive authentication data stored in a storage means arranged on the partner side; a code to collate the received authentication data with authentication data of a storage means arranged in the body; a code to authenticate the partner side in accordance with the result of collation; a code to update authentication data after completion of the authentication; and a code to write new authentication data thus updated in the storage means of the body and the partner side.

* * * * *